US006102255A

United States Patent [19]

Ellion

[11] Patent Number: 6,102,255

[45] Date of Patent: Aug. 15, 2000

[54] INVERTIBLE DISPENSING MEANS FOR SPRAY CONTAINERS

[76] Inventor: M. Edmund Ellion, 3660 Woodstock Rd., Santa Ynez, Calif. 93460

[21] Appl. No.: 09/285,245

[22] Filed: Apr. 2, 1999

Related U.S. Application Data

[63] Continuation-in-part of application No. 08/866,037, May 30, 1997, Pat. No. 5,897,032.

[51] Int. Cl.[7] ..... B65D 83/00

[52] U.S. Cl. ..... 222/321.4; 222/376; 222/382; 222/383.1; 222/464.1

[58] Field of Search ..... 222/211, 189.06, 222/189.09, 189.1, 189.4, 402.1, 321.4, 321.3, 321.7, 321.9, 376, 382, 383.1, 375, 402.18, 402.19, 464.1, 464.2

[56] References Cited

U.S. PATENT DOCUMENTS

| | | | |
|---|---|---|---|
| 3,773,013 | 11/1973 | Parker, Sr. . | |
| 4,272,257 | 6/1981 | Ellion et al. . | |
| 4,398,654 | 8/1983 | Pong et al. . | |
| 4,418,846 | 12/1983 | Pong et al. . | |
| 4,775,079 | 10/1988 | Grothoff . | |
| 5,353,969 | 10/1994 | Balderrama | 222/402.19 |
| 5,467,901 | 11/1995 | Foster et al. | 222/376 |
| 5,624,060 | 4/1997 | Ellion et al. | 222/376 |
| 5,779,108 | 7/1998 | Barriac et al. | 222/383.1 |
| 5,875,933 | 3/1999 | Ellion et al. | 222/189.1 |
| 5,899,366 | 5/1999 | Ellion | 222/376 |
| 5,988,454 | 11/1999 | Ellion | 222/376 |

*Primary Examiner*—Kevin Shaver
*Assistant Examiner*—Eric Keasel
*Attorney, Agent, or Firm*—Watson Cole Grindle Watson, P.L.L.C.

[57] ABSTRACT

A hand pump for a spray bottle permits upright or inverted operation while eliminating the need for a check valve or valves. An annular gap in the entrance section of the hand pump is so proportioned that when wet it will have the property to permit flow of liquid from the container to the dispenser, and to prevent flow of gas from the container to the dispenser. The entrance section has an axial slot therethrough and an axial groove in communication with the interior of the container and with the dispenser—the gap may be formed by a pair of circumferentially spacers. When the container is upright liquid can be removed through a distal end of a feed tube supported on the entrance section. When the container is inverted with the distal end out of the liquid and the entrance section submerged in the liquid, the liquid can be removed from the container through the axial slot, the axial groove and the annular gap.

5 Claims, 5 Drawing Sheets

INVERTIBLE DISPENSING MEANS FOR SPRAY CONTAINERS

CROSS REFERENCE TO OTHER APPLICATION

This is a continuation-in-part of Ser. No. 08/866,037, filed May 30, 1997, now U.S. Pat. No. 5,897,032.

BACKGROUND OF THE INVENTION

This invention relates to manually actuated pump sprayers for dispensing a liquid in a jet or atomization mode from spray containers, or to pressurized gas containers and, more particularly, to a feed structure that, as the result of surface tension forces, allows liquid to be expelled while preventing the flow of gas regardless of the orientation of the container.

There are two basic spray dispensing containers: the first one employs a hand pump to draw a liquid into a feed tube in liquid communication with the hand pump and then spray the liquid out of an exit orifice; the second one employs a pressurized gas to force the liquid contents into the feed tube to be dispensed when a spray valve is actuated.

The use of hand pump spray bottles or pressurized cans to dispense a variety of substances such as glass cleaners, paints, perfumes, and other personal care products, is widespread. Most of such containers have a single feed tube with an open end that extends into the liquid contents if the container is held in an upright position. In the upright position, the liquid can reach the hand pump and be dispensed or forced out the spray valve in a pressurized container. However, if the container is inverted, the entrance to the feed tube is exposed to gas, and then only gas can be expelled from the container.

There are numerous patents which relate to the design of novel feed structures and hand pumps that can operate in either the fully upright position or the fully inverted position. The teachings of many of these patents are based on using check valves that are dependent on the force of gravity to open or close the valves. Typical patents of this type are U.S. Pat. No. 4,775,079 and U.S. Pat. No. 3,733,013 where, in addition to the conventional opening at the distal end of the feed tube, a second opening is located near the hand pump or spray valve entrance in the case of a pressurized can. This second entrance is opened or closed by a ball or weight device that is seated or unseated by the force of gravity. When the container is inverted partially so that the open end of the feed tube is not in contact with the liquid and even if the second opening is immersed in liquid, the system will not operate reliably. This occurs because the component of the force of gravity is insufficient to move the ball or weight to uncover the second opening which is in contact with the liquid. The result is that the system will expel gas/air from within the container rather than liquid. Alternatively, after inverted operation, when the container is oriented approximately upright so that the distal end of the feed tube is immersed in liquid and the second opening is exposed to air, the component of gravity is insufficient to reseal the ball or weight and air is ingested into the hand pump or spray valve instead of liquid. Because of this difficulty of obtaining an acceptable gas seal with a ball or weight which is held in position by gravity, none of these types of patents provides for reliable operation at orientations between the nearly fully upright and the nearly fully inverted positions. Only at orientations of nearly upright or nearly inverted positions will the force of gravity be sufficient to seat or unset the ball or slug in a reliable fashion. A further disadvantage of this type of device is the appreciable cost of the check valve compared to the cost of the conventional hand pump or spray valve.

Another group of patents describes feed tube configurations that will pass some types of fluids but not others. These concepts do not require check valves to operate. Typical of these is U.S. Pat. No. 4,418,846 that describes two immiscible liquids, one that is a lipophilic phase and the other is a non-lipophilic phase. U.S. Pat. No. 4,398,654 describes a similar feed tube with an open end through which can pass an aqueous liquid and a tubular structure through which a non-aqueous liquid can flow. These structures operate satisfactorily only if the container is in an upright position and are mentioned here merely to show a method for allowing one type of fluid to pass and to prevent another type of fluid from passing through an opening.

There are several patents for rocket propellant feed systems that operate in zero or near zero gravity fields. U.S. Pat. No. 4,272,257 by the present inventor is typical of this type of structure. Although these patents employ surface tension devices to prevent gas from leaving the container as does this patent, none of them relates to spray bottles that operate in a gravity field and they all require multiple, complex, expensive porous entrance devices.

The aforementioned parent application Ser. No. 08/866,037 discloses a hand-pump for a spray bottle that, in addition to the conventional opening at the distal end of the feed tube, has only a single second opening. The second opening has flow passages that, when wetted, provide surface tension forces that restrict the entrance of air to the hand pump but pass liquid freely. The result is that only liquid is dispensed either in the upright or inverted position as long as either the conventional entrance to the feed tube or the second opening is immersed in liquid. Hand pumps of this design function well. The only problems are that either the feed tube must have a slot cut in it or an additional adapter piece must be provided. Both requirements add to the cost of the unit.

It is seen that some of the prior art designs will function well only under some conditions and will increase the cost of the hand pump or spray valve assembly. Hand pump spray bottles and aerosol cans are produced at a rate of well over one billion units each year at a very low unit cost. Even a fraction of a cent increase to the manufacturing cost of the hand pump or aerosol can spray valve will result in a several percent increase in the total cost of the device. A small increase in cost to provide the invertibility will add millions of dollars to the total sales cost each year. As a result, it is important to produce the hand pump or aerosol can at a minimum unit cost that will operate reliably at any orientation at which the conventional feed tube opening or a secondary opening is covered with liquid.

There is a need for a hand pump or aerosol can spray valve assembly that can operate in the upright or inverted orientation, that embodies the conventional opening in the distal end of the feed tube and a single second opening at the opposite end of the feed tube, that does not require modification of the feed tube and that has no additional parts or moving parts.

Other needs that are satisfied by this invention will become apparent from the following detailed description of the invention and the accompanying drawings.

BRIEF DESCRIPTION OF THE INVENTION

A hand pump for a spray bottle is disclosed that permits upright or inverted operation while eliminating the need for a check valve or valves. A feed tube is spaced a radial distance apart from the mating entrance to the hand pump with the aid of spacers in the entrance to the hand pump to form uniquely sized narrow axial gaps between the two elements. The dimensions of the gaps are such that, when wetted and exposed to gas, liquid surface tension forces will prevent gas from entering the gaps but, when immersed in liquid, will freely pass the liquid.

The entrance to the gaps is an axial slot in the entrance to the hand pump. The exit to the gaps is an axial passage in the entrance to the hand pump, located circumferentially from the axial entrance slot, in liquid communication with the interior of the hand pump.

In the upright position, liquid flows through the conventional opening at the distal end of the feed tube. Air in the bottle is prevented from entering the hand pump by the liquid surface tension force in the gaps.

In the inverted position when the second opening and the entrance section are immersed in liquid, the liquid flows through the axial slot formed in the entrance to the hand pump, and then into the interior of the hand pump by-passing the feed tube entirely. Since there is no air-liquid interface at the second opening, the liquid flows freely to the hand pump.

The several embodiments of the invention include forming the surface tension gap between the feed tube and the entrance of the hand pump, forming the surface tension gap between two elements of the hand pump, replacing the hand pump by pressurized gas and a spray valve.

BRIEF DESCRIPTION OF THE DRAWINGS

FIG. 1 is a side elevational view, partly broken away of a hand pump spray bottle operating upright.

FIG. 2 is a vertical sectional view, at an enlarged scale, of an invertible feed system when operating upright, taken at section 2 indicated in FIG. 1.

FIG. 3 is a cross-sectional view taken substantially along the line 3—3 of FIG. 2.

FIG. 4 is a side view of the FIG. 1 hand pump spray bottle operating inverted.

FIG. 5 is a cross-sectional view of the feed system taken substantially along the line 5—5 of FIG. 6.

FIG. 6 is a vertical sectional elevation view of the FIG. 2 feed system when operating inverted, taken at section 6 in FIG. 4.

DETAILED DESCRIPTION OF THE INVENTION

Figure 1:
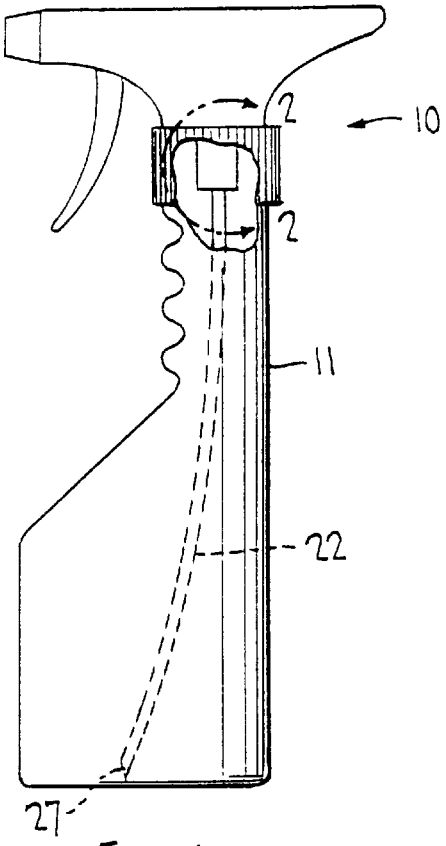
FIGS. 1 to 6 illustrate my previous invention shown in FIGS. 18 and 19 of parent application Ser. No. 08/866,037, now U.S. Pat. No. 5,897,032.

The invertible hand pump of the present invention will be described in detail with reference to the accompanying drawings. In these drawings, the different embodiments of the devices have some common elements of construction. In order to simplify the description of these embodiments, like elements will be identified by like reference numerals for all embodiments.

Figure 18:
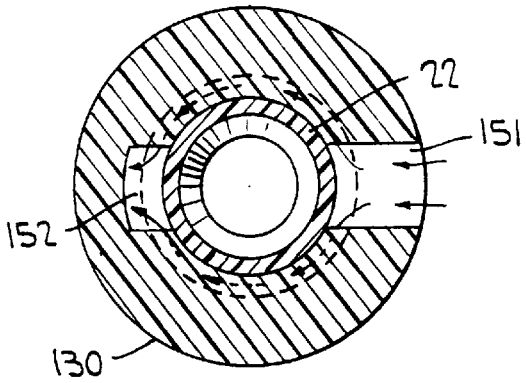
FIG. 18 is a cross-sectional view taken substantially along the line 18—18 of FIG. 17.
Figure 19:
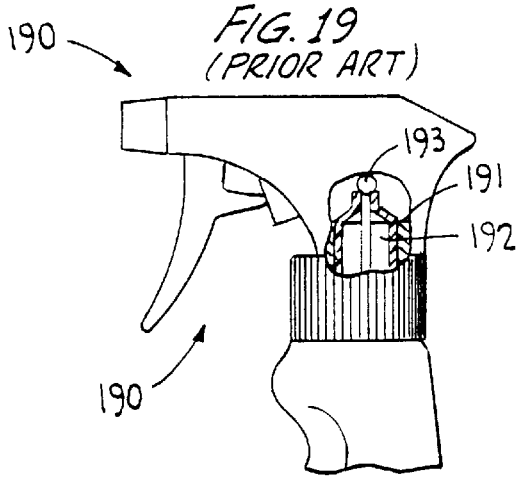
FIG. 19 (PRIOR ART)
FIG. 19 is a side elevational view of a prior art hand pump in partial section showing the location of the inlet ball check valve, the pump body and the entrance section.

One embodiment of my earlier invention which is set forth by FIGS. 18 and 19 of parent application Ser. No. 08/866,037, will be described first and will then be followed by the several embodiments of the present invention.

Figure 2:
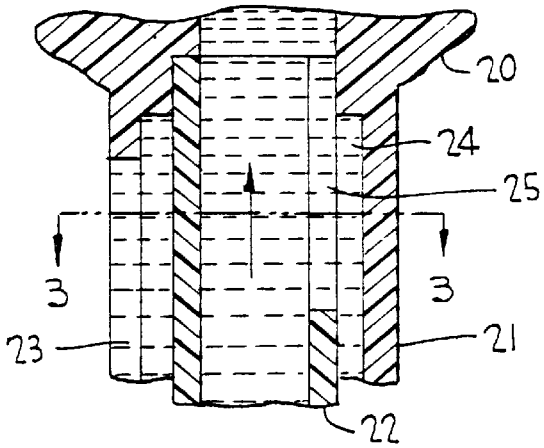

FIG. 1 illustrates a hand pump generally designated 10 mounted on a typical prior art 17 oz. capacity plastic spray bottle 11. FIG. 2 shows the hand pump as having a pump body 20 with a depending cylinder (or pump entrance section) 21 spaced from a feed or dip tube 22 depending from the pump body, an axial slot 23 in cylinder 21, an annular gap 24 between the feed tube 22 and the entrance section 21, and an axial slot 25 in the feed tube 22.

Figure 3:
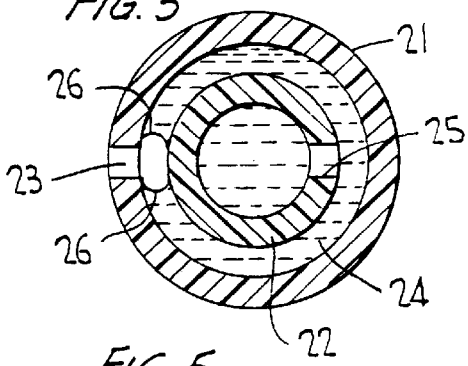

FIGS. 2 and 3 illustrate the operation in the upright position. When the hand pump is activated, liquid from the bottle 11 is drawn up the feed tube 22, via its distal end 27, into the pump in the direction of the arrow of FIG. 2. Liquid that is in the appropriately sized annular gap 24 forms a surface tension force at the air-liquid interface 26 (FIG. 3) that prevents air from being ingested into the hand pump. The result is that only liquid is dispensed from the bottle.

Figure 4:
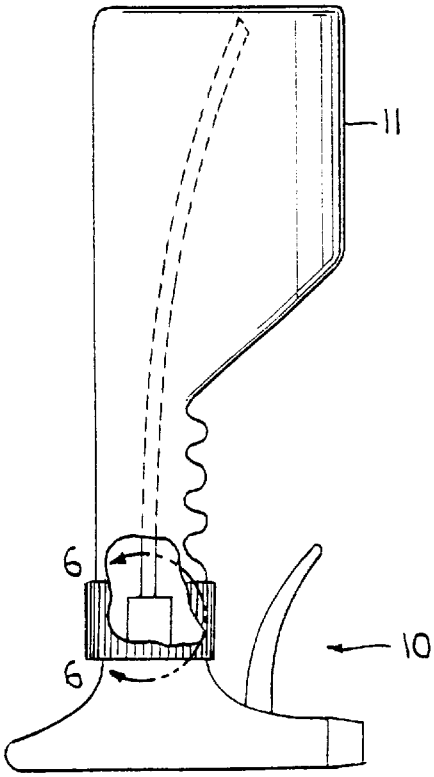
Figure 5:
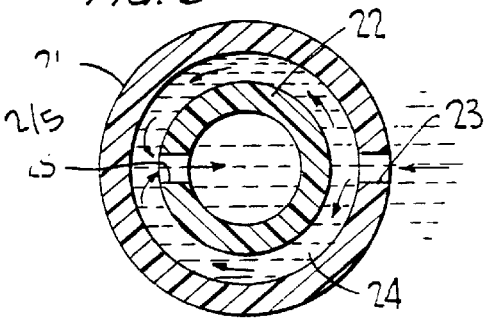
Figure 6:
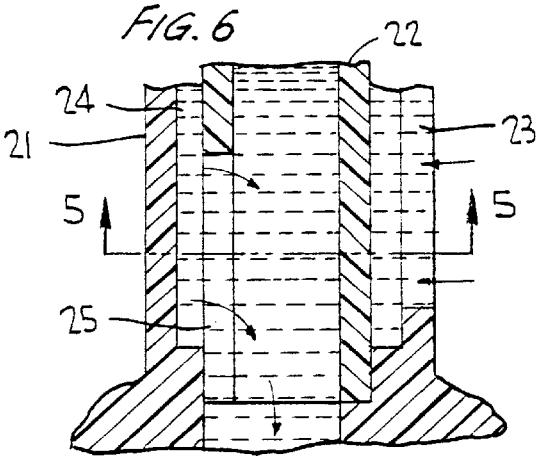

FIGS. 4 to 6 illustrate the dispensing package of FIG. 1 operating in an inverted position with the same feed system as in FIGS. 2 and 3. It is seen that there is no air-liquid interface at this orientation since the slot 23 in the entrance section 21 is immersed in liquid. As a result, liquid can flow freely through the slot 23 into the gap 24 to the slot 25 into the feed tube 22 and into the hand pump, as shown by the directional arrows of FIGS. 5 and 6.

The aforedescribed device according to my earlier invention operates well at any orientation at which either the conventional opening at the distal end 27 (FIG. 1) of the feed tube 22, or the slot 23 in the entrance 21 to the hand pump, is immersed in liquid. However, it is difficult in high volume production devices to maintain the close tolerances between the entrance section 21 to the hand pump and the feed tube 22 that are necessary for the device to operate reliably since the feed tube 22 is supported only at one end. A typical gap size is 0.001 to 0.005 in. and the typical tolerance for the feed tube 22 and hand pump entrance 21 is ±0.003 in. As a result it is difficult in high volume production to obtain the required gap initially and it is difficult to maintain the gap size along the entire length of the gap. Moreover with this device the slot 25 must be cut in the feed tube 22 which may add cost to the unit.

The device according to the present invention eliminates the difficulty of obtaining and maintaining the required dimension of the gap, eliminates the need for cutting a slot in the feed tube, and requires no additional parts or any moving parts. Thus, the difficulties of the prior invertible devices are substantially eliminated by the invention.

Figure 7:
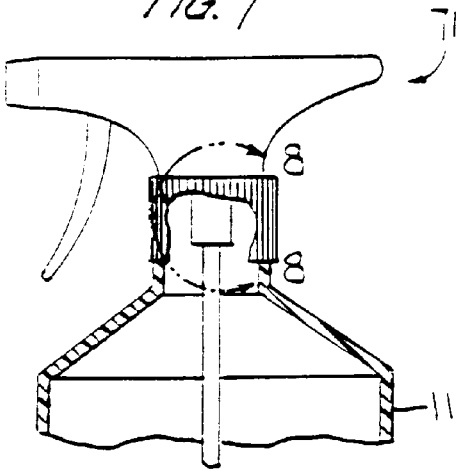
FIG. 7 is a partial sectional elevational view of a hand pump incorporating the invention, shown during upright operation.
Figure 8:
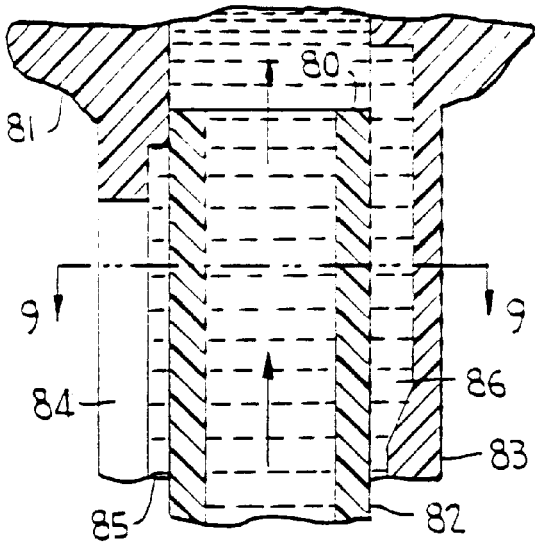
FIG. 8 is a vertical sectional view of a feed tube and entrance to the FIG. 7 hand pump during upright operation illustrating the liquid flow, taken at section 8 in FIG. 7.

FIG. 7 illustrates a hand pump 71 mounted on spray bottle 11. As shown in detail in FIG. 8, pump body 81 of hand pump 71 suspends a dip or feed tube 82 as in any normal manner. The hand pump 71 illustrated in FIG. 8 is shown in upright operation and has a depending cylinder 83 defining an entrance section surrounding the upper portion of the feed tube. An axial slot 84 in the entrance section 83 of the hand pump 71 provides fluid communication from the interior of the container to the annular gap 85 formed between the feed tube 82 and the entrance section 83 of the hand pump 71 to the axial passage 86 in the entrance section 83 and into the hand pump 71. The axial passage 86 (which may be formed by an open notch) terminates at its upper end in FIG. 8 beyond the upper fixed end 80 of tube 82. Passage 86 thus eliminates the need for cutting the feed tube 82 and provides a low resistance flow entrance to the hand pump 71. Slot 84 and passage 86 are circumferentially spaced apart about 180° as shown, for each of the several embodiments of the invention.

Figure 9:
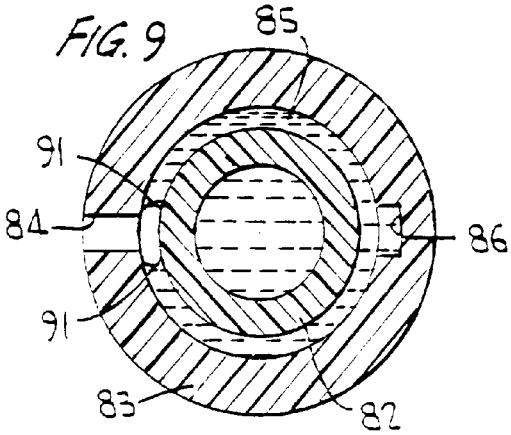
FIG. 9 is a cross-sectional view taken substantially along the line 9—9 FIG. 8.

In operation, liquid from the container is drawn into the open distal end (not shown) of feed tube 82 into the hand pump 71 during upright operation in the direction of the arrows of FIG. 8. Since the slot 84 is not immersed in liquid during upright operation (but has been wetted prior to upright operation), there is an air-liquid interface 91 as illustrated in FIG. 9. A surface tension force is formed at the interface 91 by the liquid in the gap 85. As a result, the air in the container cannot enter the annular gap 85 and only liquid is dispensed from the hand pump 71.

FIG. 9 clearly illustrates the slot 84 in the entrance section 83 to the hand pump 71, the gap 85, the axial passage 86 and the air-liquid interface 91 that forms the surface tension force to prevent ingesting of air during operation of the hand pump.

Figure 11:
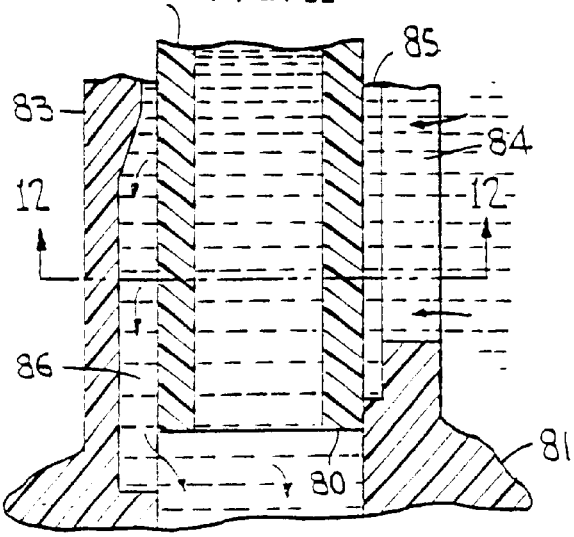
FIG. 11 is a vertical sectional view of the FIG. 8 feed tube and entrance showing the flow path during inverted operation, taken at section 11 of FIG. 10.
Figure 10:
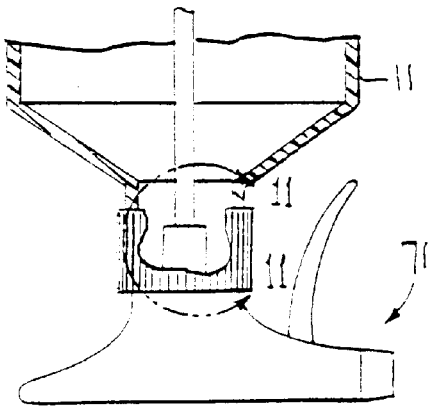
FIG. 10 is a partial sectional elevationed view of the FIG. 7 hand pump shown during inverted operation.

FIGS. 10 and 11 show the inverted operation of the FIGS. 7,8 hand pump and bottle 11 on which it is mounted. The flow of liquid is indicated by the directional arrows in FIGS. 11, 12 as entering the slot 84 in the entrance section 83 to the hand pump, flowing around tube 82 in the gap 85 between the feed tube 82 and the entrance 83 and then to the axial passage 86. The liquid then flows axially in the axial passage 86, beyond the end of tube 82 and then into the hand pump 71.

Figure 12:
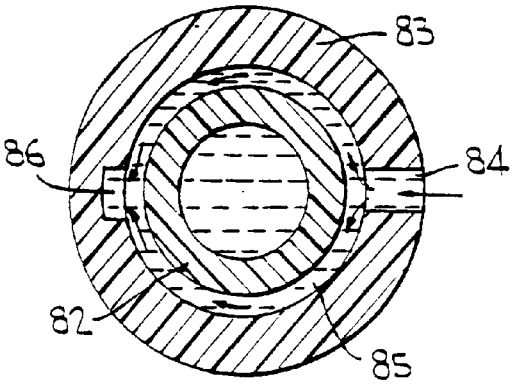
FIG. 12 is a cross-sectional view taken substantially along the line 12—12 of FIG. 11 showing the flow path during inverted operation.

As shown in FIG. 12, since the slot 84 is immersed in liquid during inverted operation, there is no air-liquid interface and therefore no surface tension force. As a result, the liquid can flow freely into the gap 85, through the axial passage 86 and beyond fixed end 80, and then into the hand pump 71, as indicated.

Figure 13:
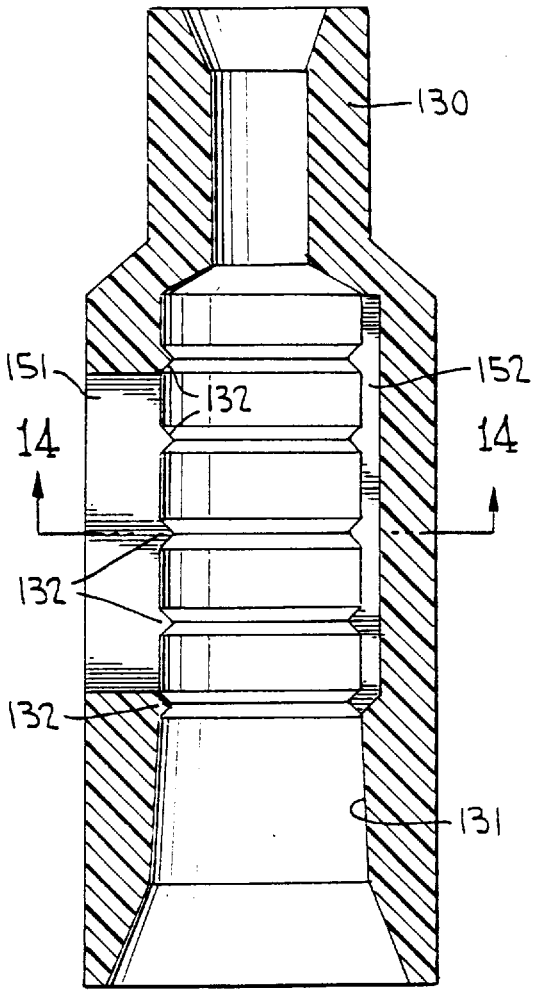
FIG. 13 is a vertical sectional view of the hand pump inlet with spacer according to another embodiment of the invention.

FIG. 13 illustrates the means by which the size of the desired surface tension gap is maintained in a practical high volume production device. As mentioned above, it is not possible in a production device to obtain the desired dimension of the surface tension gap by controlling both the dimensions of the feed tube and the entrance to the hand pump. Instead of requiring close control of the dimensions of both the feed tube and the hand pump entrance section, the device according to this embodiment controls the gap by using unique spacers and relies on compression of the feed tube.

Tube retainer 130 illustrated in FIG. 13 has the interior wall of the entrance section 131 thereof to the hand pump provided with a series of axially spaced circumferential spacers 132. These spacers each extend radially between 0.001 and 0.005 in. from the wall on which they are formed depending on the particular hand pump and bottle. It is common practice in the production of a plastic part to form perturbations of these of even smaller dimension.

Figure 15:
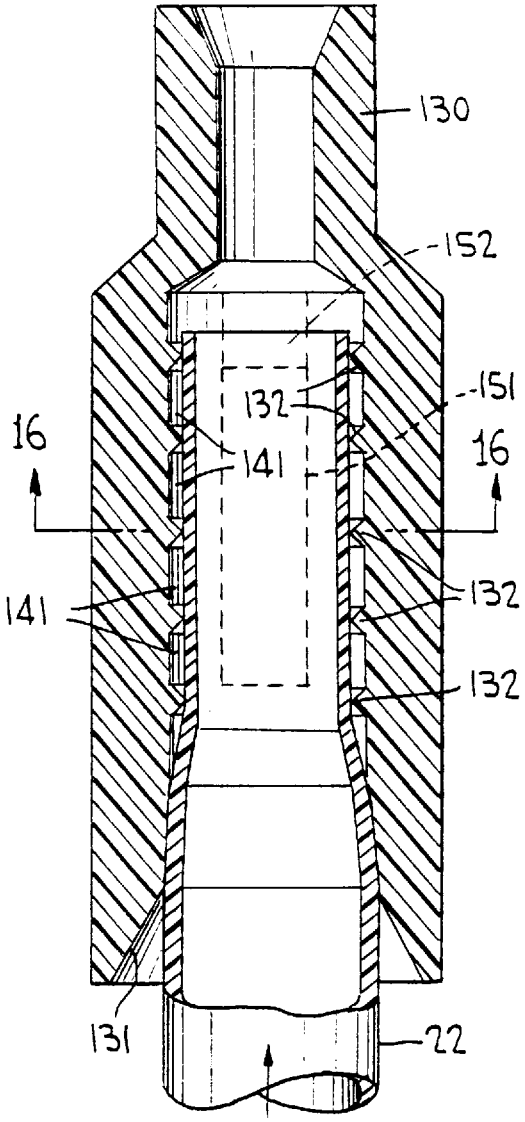
FIG. 15 is a partial vertical sectional view of the feed tube mounted within the FIG. 13 hand pump inlet.
Figure 14:
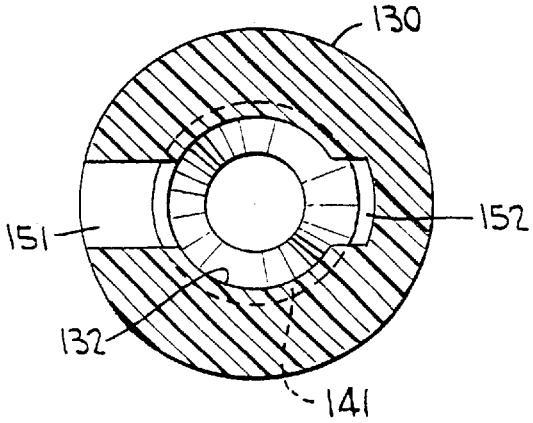
FIG. 14 is a cross-sectional view taken substantially along the line 14—14 of FIG. 13.

The conventional feed tube 22 is inserted into the entrance 131 to the hand pump and is compressed by the spacers 132 as illustrated in FIG. 15. The result is that, for example, four annular gaps 141 are formed that have dimensions to provide the desired surface tension force when wetted. The compression of the feed tube 22 is common practice since normally the feed tube 22 is compressed several thousandths of an inch as it is inserted into the hand pump entrance of the tube retainer in order to retain it in position. The result of the spacers 132 is that there are precisely controlled gaps formed between the feed tube and the wall of the entrance to the hand pump that were not available heretofore where both the entrance diameter and the feed tube diameter must be held to unreasonably close tolerances.

Figure 16:
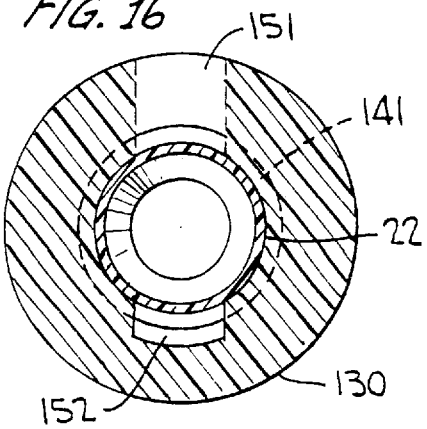
FIG. 16 is a cross-sectional view taken substantially along the line 16—16 of FIG. 15.

FIGS. 13 to 16 each show the tube retainer 130 as having an inlet axial slot 151 extending through its sidewall, as well as an enlarged exit passage 152 formed as an inner axial grove in its sidewall which terminates at its upper end beyond the upper fixed end of tube 22 (FIGS. 13, 15). FIGS. 15 and 16 illustrate the flow of liquid during upright operation. The arrows in FIGS. 17 and 18 illustrate the flow of liquid during inverted operation.

Figure 17:
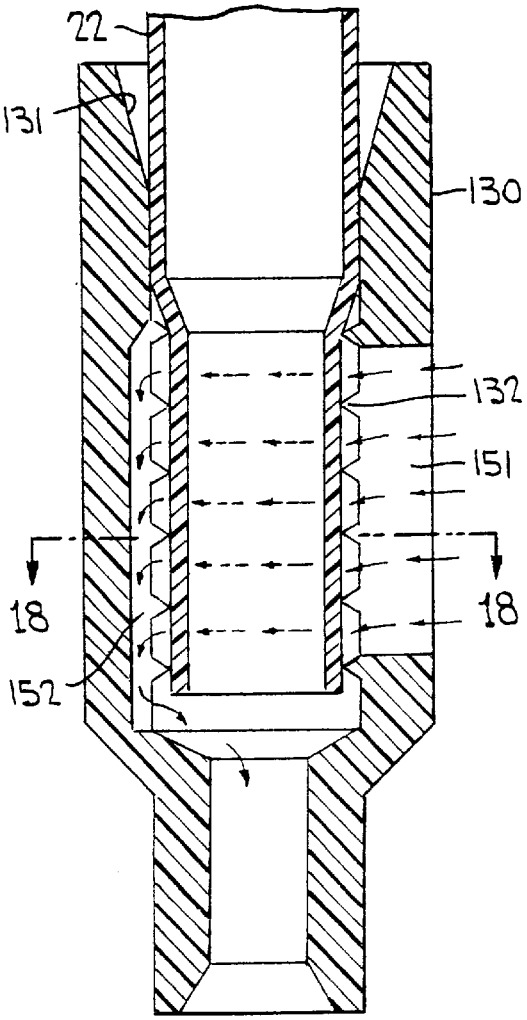
FIG. 17 is a vertical sectional view of the feed tube mounted within in the FIG. 15 hand pump inlet showing the inlet axial slot, the control gaps and the axial passage.

It is seen that the device of FIG. 17 with axial slot 151 in the entrance to the hand pump, spacers 132 formed on the inner wall of the entrance 131 and axial passage 152 formed in the inner wall of the entrance 131 will provide the desired dimensions of the annular gaps 141 and eliminate the need to cut a slot in the feed tube 22. The result is a device that can be manufactured in large volume at low cost and provides precisely controlled gaps.

It is possible to configure the device to form the surface tension control gaps between two elements of the hand pump instead of employing the feed tube as one such element. FIG. 19 illustrates a typical prior art hand pump 190 having three elements of interest—a pump body having an entrance section 191 to the hand pump, the tube/ball valve retainer 192, and the inlet ball check valve 193. The ball check valve 193 allows liquid to flow into the hand pump during the suction stroke and prevents the flow back into the bottle during the compression/discharge stroke of the hand pump as the ball seats against its valve seat formed at the upper end of ball retainer 192.

Figure 20:
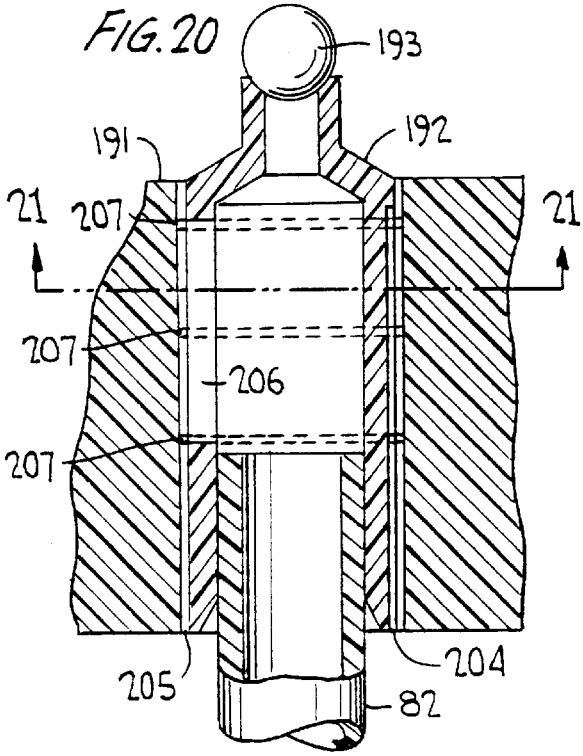
FIG. 20 is an enlarged partial vertical sectional view of the FIG. 19 hand pump entrance section, pump body, inlet ball check valve and feed tube, as modified in accordance with yet another embodiment of the invention.
Figure 21:
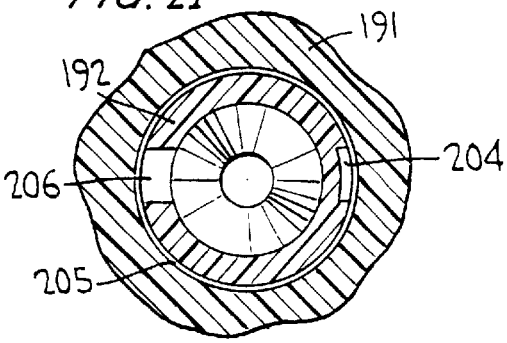
FIG. 21 is a cross-sectional view taken substantially along the line 21—21 of FIG. 20.

FIGS. 20 and 21 illustrate the surface tension gaps that are formed between the hand pump entrance section 191 and the ball retainer 192. The operation is similar to that in which the feed tube is formed on one side of the gap that has been described previously. An axial passage 204 formed in the outer wall of tube retainer 192 provides an entrance for liquid to enter the gap 205, and an axial through slot 206 formed in the wall of tube retainer 192 slot 206 provides passage of the liquid into the hand pump. The retainer 192 is spaced from the wall of the entrance section 191 by axially spaced circumferential spacers 207 formed on the outer surface of the tube retainer to form annular gap 205, in a similar manner as with the feed tube.

It will be instructive to illustrate the required controlling dimensions of the device, i.e., the thickness of the annular gap 205 and the length of the axial passage 204 for a typical 17 oz. capacity bottle.

Consider the bottle operating in the upright position. The required maximum thickness of the gap can be determined by knowing that the liquid will be 8 in. below the gap 205 when the bottle is almost empty. A balance of pressure and surface tension forces at the interface of the air and liquid indicates that the thickness of the gap must be equal to:

$$T \leqq 2s/(P_1 - P_a) \quad (1)$$

where: T=thickness of the gap, s—surface tension of the liquid, $P_1$=pressure of the liquid, $P_a$=pressure of the air.

The pressure of the liquid in the gap when not spraying is equal to the pressure of the air minus the product of the height of the gap above the liquid level (8 inches in the most adverse condition) and the density of the liquid (0.036 lb./cu.in). During the suction stroke of the hand pump, the pressure of the liquid decreases by approximately 0.1 psi. Thus the value of $(P_1 - P_a)$ is 8×0.036 plus 0.1 or 0.388 psi. From equation 1, the required thickness, if the liquid were water, would be 0.002 in. It is seen that the thickness of the gap is determined by the height of the liquid in the bottle and the rate at which liquid is pumped from the dispenser.

Figure 22:
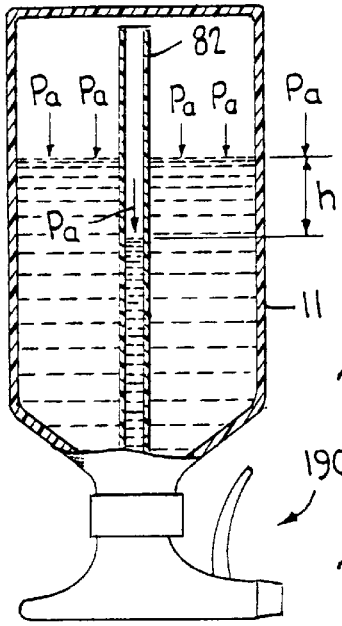
FIG. 22 is a vertical sectional view of a spray bottle, to which a trigger sprayer is attached incorporating the invention, operating in the inverted position.

The required length of the axial passage 204 and the axial slot 206 can be determined by knowing the pressure drop through the gap 205. When the bottle is inverted and the hand pump is not operated, the liquid in the feed tube will be at the same level as the surrounding liquid in the bottle. When the hand pump is operated, as illustrated in FIG. 22, liquid flows from the interior of the feed tube, to the hand pump and this quantity of liquid is only partially replaced by the liquid flow through the gap. The result as determined by standard hydraulic analysis in that the liquid in the feed tube falls a slight amount h until the level is below the surrounding liquid level by an amount equal to the pressure drop through the gap divided by the density of the liquid. FIG. 22 illustrates this condition. If the level drops to the level of the hand pump, air will be ingested instead of liquid. As a result, it is important that the pressure drop through the gap be low. The pressure drop through the gap is determined by the thickness of the gap and the length of the axial passage and axial slot as well as the rate at which the hand pump dispenses the liquid. A test with conventional hand pumps has indicated that a one inch long axial inlet will limit the drop in the level within the feed tube to about one-half inch. In this case only one-half inch of liquid will not be pumped out of the bottle in the inverted position. This is less than a fraction of a percent of the total capacity since the typical spray bottle has a narrow neck so that in the inverted position, one-half inch of liquid is a very small quantity. This condition does not affect the operation during upright pumping where the entire contents can be dispensed.

Figure 23:
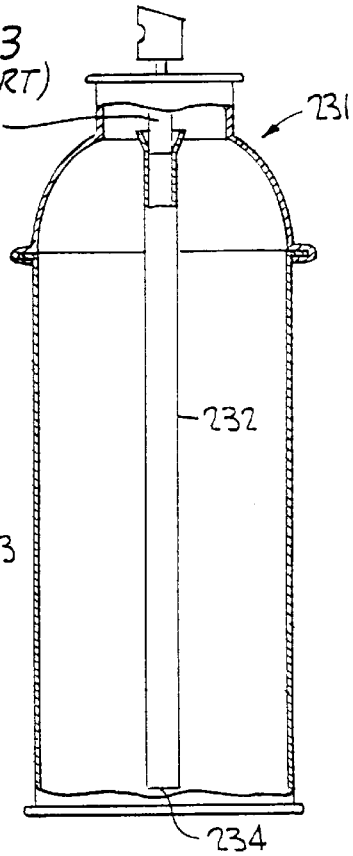
FIG. 23 (PRIOR ART)
FIG. 23 is vertical sectional view of a prior art aerosol spray can.

In the conventional aerosol can 231, FIG. 23, the feed tube 232 is stretched over the valve inlet 233. During upright operation, when the spray valve is opened, liquid from the can is forced into the distal open end 234 of the feed tube 232 by the pressure of the gas in the can. However, if the can is inverted, only the gas in the container can enter the feed tube and no liquid can be dispensed.

Figure 26:
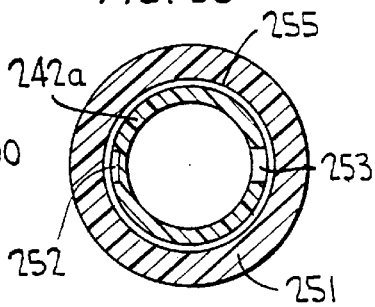
FIG. 26 is a cross sectional view taken substantially along the line 26—26 of FIG. 25.
Figure 25:
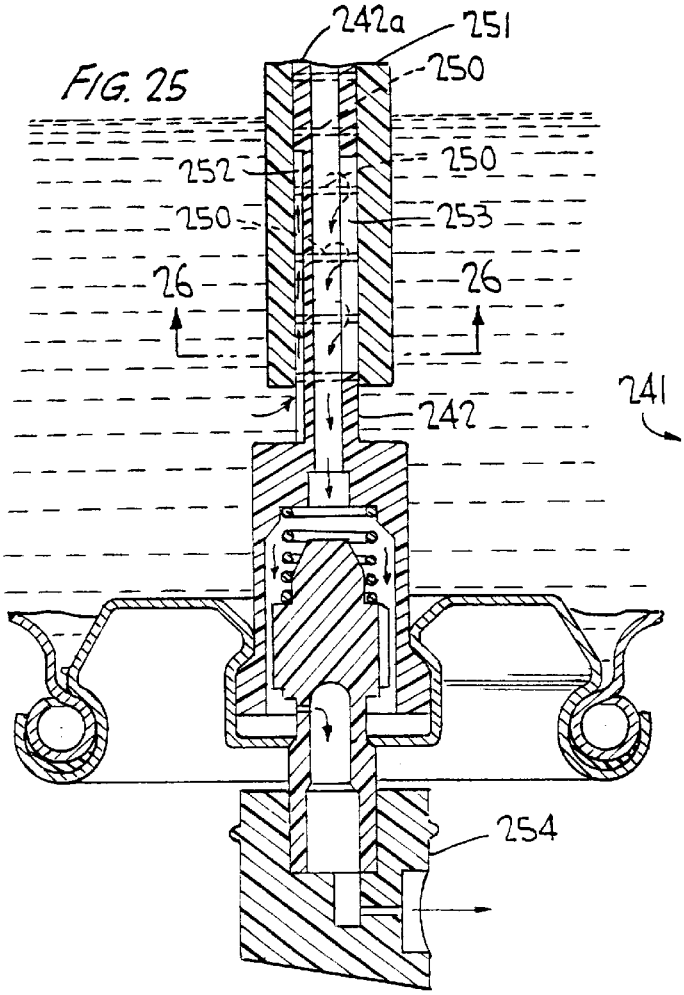
FIG. 25 is an enlarged view of the pertinent elements of the FIG. 24 spray can.
Figure 24:
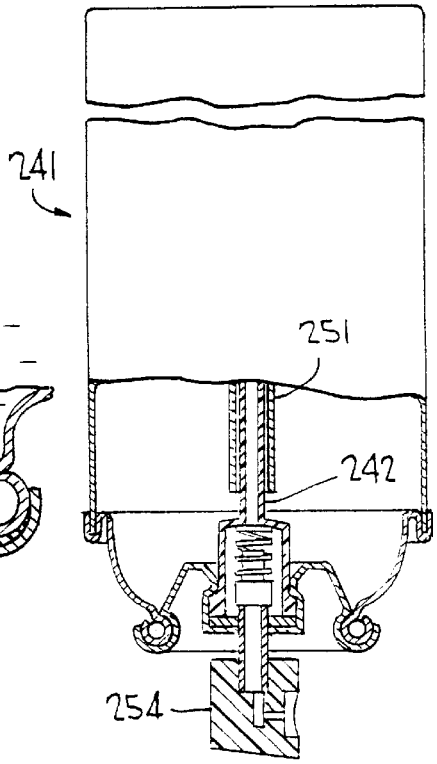
FIG. 24 is partial vertical sectional view of an aerosol spray can illustrating the elements of still another embodiment of the invention.

FIG. 24 illustrates the device according to the invention incorporated in an aerosol can 241, with the pertinent area being enlarged in FIG. 25. The entrance section 242 to the spray valve is modified and forms one wall of the surface tension control gap. The other wall of the gap is formed by the interior wall of the feed tube 251. An axial open notch forming an axial passage 252 that can admit liquid when the container is in the inverted position is formed in the outer wall of an elongated tubular section 242*a* of entrance 242. Circumferential spacers 250 are formed on the outer surface of section 242*a* in order to space the feed tube 251 at the desired distance form the wall of the section 242*a* in order to provide the surface tension control gap 255 as illustrated in FIG. 26. An axial slot 253 is cut in the entrance 242 at its section 242*a* to the valve that is spaced circumferentially from the axial passage 252. In the inverted operation, liquid flows into the axial passage 252, around the gap 255 formed between the entrance section 242*a* and the feed tube 251, through the axial slot 253 and to the spray valve 254, as shown by the directional arrows in FIG. 25.

In the upright position, the gas is prevented from entering the valve by the surface tension force in the gap and liquid enters the valve through the distal open end of the feed tube 251 as in the other embodiments.

This invention is not to be limited by the embodiments shown in the drawings and described in the description, which are given by way of example and not of limitation, but only in accordance with the scope of the appended claims.

What is claimed is:

1. Apparatus for dispensing liquid while in any orientation, comprising:

manually operated dispensing means mounted on a liquid storage container having an upright axis;

said dispensing means having a tubular entrance section surrounding a hollow tubular feed tube suspended at one end by said dispensing means, said tube having a distal end opening into the container at a location spaced from said dispensing means;

an inner wall of said entrance section being spaced from an outer wall of said feed tube for therewith defining at least one annular gap;

said entrance section having at least one axial slot extending therethrough to establish communication between said inner wall thereof and the interior of said container;

said inner wall of said entrance section having at least one axial groove formed therein defining a flow passage, said groove terminating beyond said one end of said feed tube;

said gap being so proportioned that when wet it will have the property to permit flow of liquid from the container to said dispensing means, and to prevent flow of gas from the container to said dispensing means, whereby when the container is in an inverted position with the distal end of the tube out of the liquid and said entrance section submerged in the liquid, the liquid can be removed from the container through said axial slot, said gap and said flow passage.

2. The apparatus according to claim 1, wherein said axial slot and said axial groove are circumferentially spaced apart.

3. The apparatus according to claim 1, wherein said dispensing means comprises a hand pump.

4. The apparatus according to claim 1, wherein said dispensing means comprises a pressurized gas spray valve.

5. The apparatus according to claim 2, wherein said slot and said groove are circumferentially spaced apart about 180°.

* * * * *